United States Patent [19]

Green, Sr.

[11] 4,285,993

[45] Aug. 25, 1981

[54] ANTI-CORROSIVE STRUCTURE ANCHOR ASSEMBLY

[76] Inventor: John H. Green, Sr., P.O. Box 1146, Crane, Tex. 79731

[21] Appl. No.: 25,593

[22] Filed: Mar. 30, 1979

[51] Int. Cl.[3] ..... B05D 3/02; E21D 20/00; E02D 5/74

[52] U.S. Cl. ..... 427/195; 52/155; 52/515; 405/260; 405/262; 427/318; 427/374.4; 427/379; 427/386; 427/398.1; 428/418

[58] Field of Search ..... 52/515, 155; 427/185, 427/195, 318, 386, 374.4, 379, 398.1; 428/418; 405/260, 262

[56] References Cited

U.S. PATENT DOCUMENTS

| | | | |
|---|---|---|---|
| 3,532,531 | 10/1970 | Stallard | 427/195 X |
| 3,850,664 | 11/1974 | Siegmund | 427/195 |
| 3,864,316 | 2/1975 | Robinson | 427/195 X |
| 4,060,655 | 11/1977 | Johannes | 427/195 X |
| 4,124,983 | 11/1978 | Weatherby | 405/260 |
| 4,178,726 | 12/1979 | Watson | 52/515 X |

*Primary Examiner*—Michael R. Lusignan
*Attorney, Agent, or Firm*—Harvey B. Jacobson

[57] ABSTRACT

An expanding earth anchor assembly is disclosed for attaching cable means or the like conveniently employed in supporting utility, communication, or other above ground structures. Jaws attached to an anchor rod are expandable outwardly by rotation of the rod from above the surface of the ground when the jaws are inserted to a proper depth and at an appropriate angle in the soil. An important aspect of the invention resides in protection of the anchor rod assembly located below ground level, inasmuch as anchor rods buried in the ground are ordinarily subject to an accelerated rate of electrolytic corrosion, which is avoided through practice of the invention.

9 Claims, 17 Drawing Figures

32
34
30
28
31
58
24
28
36
42
26
60
22
40
38

30
28
20
31
58
28
24
42
26
36
40
38

28
52
42
36
26
44
22
46
26
46
46
38
60
64
50
48
40

28
62
48
64
50
38
40

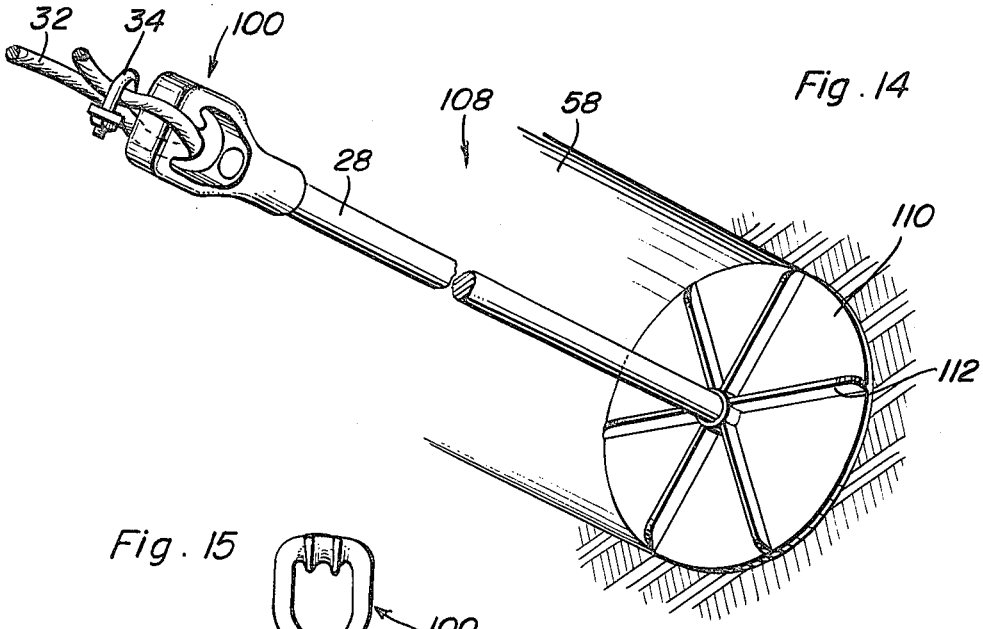
Fig. 14
Fig. 15
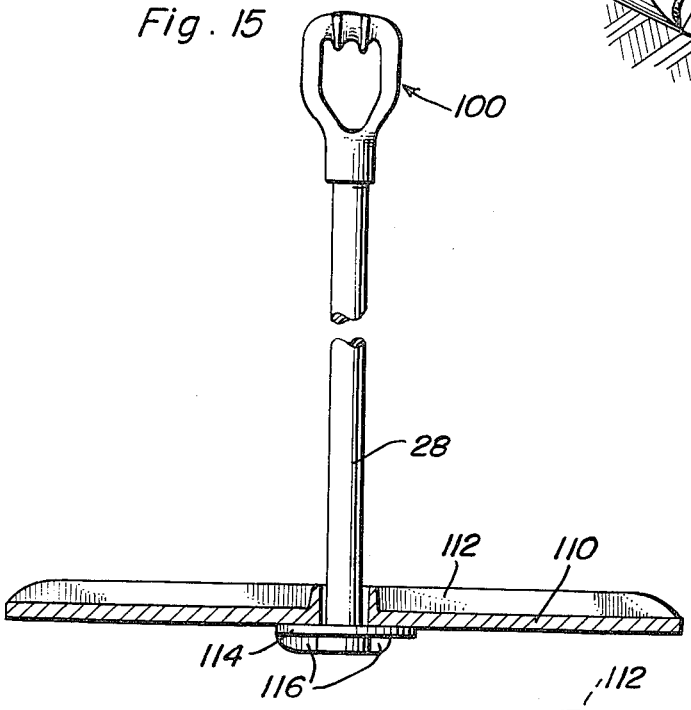
Fig. 16
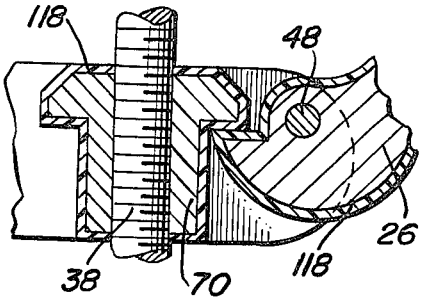
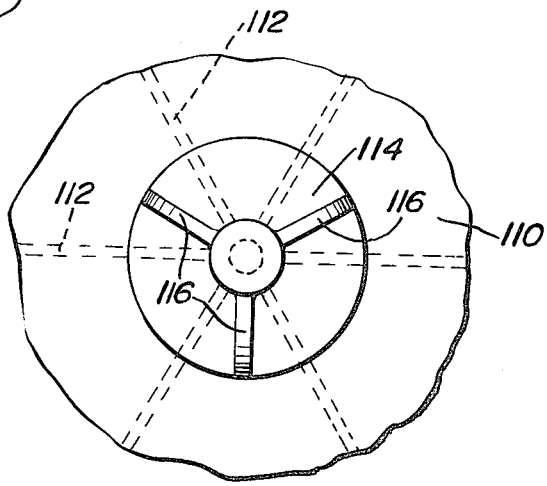
Fig. 17

ANTI-CORROSIVE STRUCTURE ANCHOR ASSEMBLY

BACKGROUND OF THE INVENTION

1. Field of the Invention

The invention relates to an anchor assembly for above ground structures, such as utility towers, communication towers, oil field structures, and the like. More particularly, expandable jaws opening outwardly to engage the soil provide a secure anchor for a rod which serves as the point of attachment for cables, guy wires, or the like conventionally employed in support of above ground structures. The anchor assembly includes a pressure plate for causing outward expansion of the jaws on rotation of the anchor rod from above the surface of the ground. Furthermore, coating of the entire assembly with a fusion-bonded epoxy coating provides protection against electrolytic corrosion and protects against the accelerated rate of corrosion conventionally present in anchor rods which are subject to passage of below ground electrical currents found to be present with buried structures.

2. Description of the Prior Art

The prior art includes earth anchoring devices having expansible blades, for supporting guy wires, posts, telephone poles, and the like. For example, Lewis in U.S. Pat. No. 930,486, patented Aug. 10, 1909, shows an anchor having expanding flukes which pass through and outwardly from the mushroom-shaped crown by rotating a projecting shank independently of the crown. Cole et al. in U.S. Pat. Nos. 1,606,146 and 1,606,147, both issued Nov. 9, 1926, disclose earth anchor devices having anchor blades which can be expanded outwardly by a blade expanding head which engages a locking holder on the blades to lock the blades in their fully extended position, or by an anchor head for use with an associated expander tube with respect to which a rod rotates for frictional engagement with a body portion so as to cause expansion of blades associated therewith. Neither of the Cole et al. patents teaches ribbing on the upper surface of the blades for a locking action.

Bowen in U.S. Pat. No. 1,015,611, patented Jan. 23, 1912, discloses a threaded rod in association with a concavo-convex spreader plate which has its convex surface directed downwardly and which forces the blades, which also have their convex surfaces directed downwardly, in an outward direction. Such an arrangement is not protected from contact with loose soil, a particularly important consideration when mounting an earth anchor at a substantial angle from the vertical. Ogburn in U.S. Pat. No. 2,676,412, patented Nov. 27, 1951, discloses an earth anchor having a plurality of blades which are carried on a follower block and which pass through openings in a spreader block for outward gripping of the earth. Both the Ogburn and Lewis structures, however, are subject to binding where the wings or blades pass through openings during the expansion operation, and any corrosion is likely to render the device inoperable due to seizing of a blade at the opening.

None of the structures of earth anchor assemblies described above includes a ribbed blade surface for expediting locking of the blades in the expanded configuration.

Weatherby, in U.S. Pat. No. 4,124,983, issued Nov. 14, 1978, discloses a corrosion protected earth tieback having a first thin hard coating of corrosion resistant plastic throughout its length and a second coating formed from a heat shrunk plastic tube encapsulating a portion of the rod connecting a grounded anchor to the structure being anchored. The method of protecting the device of Weatherby from corrosion, however, is complex, expensive, and makes specific reference to the unsuitability of epoxy coatings for corrosion protection.

Fusion-bonded epoxy coating products are disclosed in the technical brochure entitled "Product Data-101, 110, and 117 Fusion-Epoxy Coatings," published by 3M Company, Electro-Products Division, St. Paul, Minn. Further technical information is found in a technical publication from the same source entitled "Coating Recommendations—Fusion-Bonded Epoxy Coating Powders, 100, 200, 1,000 Series."

SUMMARY OF THE INVENTION

It has been found that earth anchor devices of the expanding jaw type, particularly when used in combination with cables for supporting high tower structures, such as utility towers, oil field derricks, communication facilities, and the like, experience a greatly accelerated rate of corrosion resulting from electrical current traveling along the anchoring device. This causes deposits of metal oxide to form near the lower portions of the anchor assemblies, with the possibility of consequent failure of the associated anchor system. The present invention provides an expanding jaw anchor assembly protected from falling soil debris by a pressure plate which is engageable with lock lugs to hold the expanded jaws in maximum open position. The invention further provides for corrosion protection by application of a fusion-bonded epoxy coating to give positive protection against oxidative electrolysis corrosion.

Accordingly, it is a principal object of the invention to provide an improved expanding jaw anchor assembly for securing above ground structures, such as utility towers, oil field derricks, communication towers at communication installations, and the like.

Another important object of the invention is to provide a corrosion protection and prevention system comprising a coating of fusion-bonded epoxy, and to provide a method for coating the anchor assembly of the present invention.

Still another object is to provide an expanding anchor assembly which exceeds current safety standard requirements, such as those of the U.S. Occupational Safety and Health Administration.

A further object is to furnish an expanding jaw anchor assembly having an interlocking safety feature comprising lock lugs on which a pressure plate rests, holding the jaws to a maximum opened position and preventing a closing of the jaws of the assembly.

Yet another object is to provide a pressure plate for forcing the jaws to expand in a manner which protects the assembly from loose soil debris.

Still another further object is to provide protection of an exanding jaw anchor assembly sufficient to provide a usable lifetime of at least 25 years.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 14 is a perspective view of a form of the invention not having expandable jaws, but relying instead on a retaining plate buried below ground level and not requiring expandable jaws or mechanical manipulation prior to use.

FIG. 15 is a vertical sectional view of the device of FIG. 14.

FIG. 16 is a vertical sectional view of an expandable portion, such as is illustrated in FIG. 5, but shown in the expanded configuration and having a coating of synthetic resin for electrolytic corrosion protection.

FIG. 17 is a bottom plan view of a central fragmentary portion of the earth anchoring device of FIG. 15.

DESCRIPTION OF THE PREFERRED EMBODIMENTS

Figure 2:
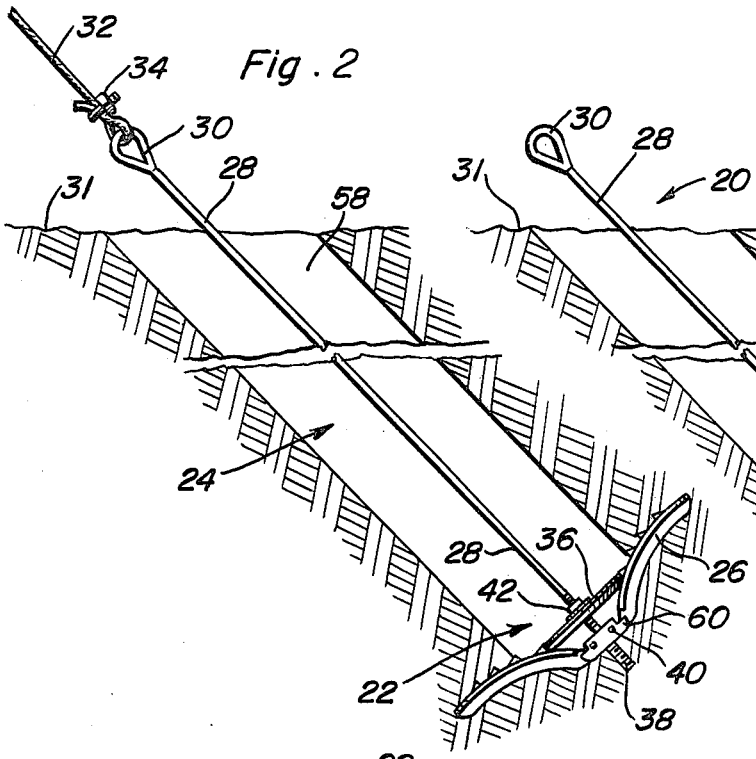
FIG. 2 is a side elevational view of the same device after expansion of the jaws, showing the device in use to anchor a cable or guide wire.

In the first form of the invention, illustrated in FIGS. 1, 2, 3, 4 and 5, a fastening portion 20 is connected to an expandable portion 22 of the anchor assembly 24, the expandable portion 22 having four jaws 26 pivotally expandable outwardly to the configuration shown in FIG. 2. A second form of the invention, shown in FIGS. 5, 6, 7 and 10 has only three jaws 26 which expand outwardly in a similar fashion. The jaws shown in FIGS. 8 and 9 can be used with either the first or second form of the invention, as can the pressure plate shown in FIGS. 11 and 12. In the third form of the invention, illustrated in FIGS. 14, 15 and 17, a plate alone, rather than an expanded jaw arrangement, is used. In all forms of the invention, the devices are preferably coated with a synthetic resin composition, preferably a fusion-bonded epoxy coating, to prevent or minimize electrolytic corrosion when in use underground. Preferably, such coating covers all exterior surfaces, such as is illustrated in FIG. 16.

Figure 1:
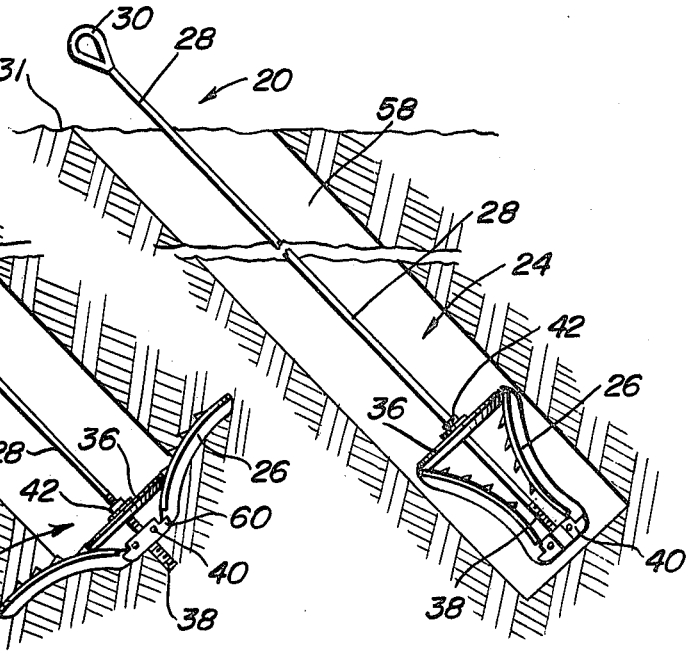
FIG. 1 is a side elevational view of a form of the earth anchor assembly of the present invention in place below ground level as inserted at a desired angle in the ground before expansion of the jaws.

Fastening portion 20 of the device illustrated in FIG. 1 comprises an anchor rod 28, which provides communication between eye section 30 above ground level 31 and expandable portion 22, buried below ground level. Cable 32 can be attached to eye 30 with retainer 34 after expansion of jaws 26 to the configuration of FIG. 2 by rotation of anchor rod 28 with respect to pressure plate 36. Anchor rod 28 has a lower threaded portion 38 to receive compatibly threaded lock nut 40. Pressure plate 36 is free to slide longitudinally along anchor rod 28, held in place by contact about its periphery with jaws 26 and by contact with pressure washer 42, welded in place on anchor rod 28.

Figure 3:
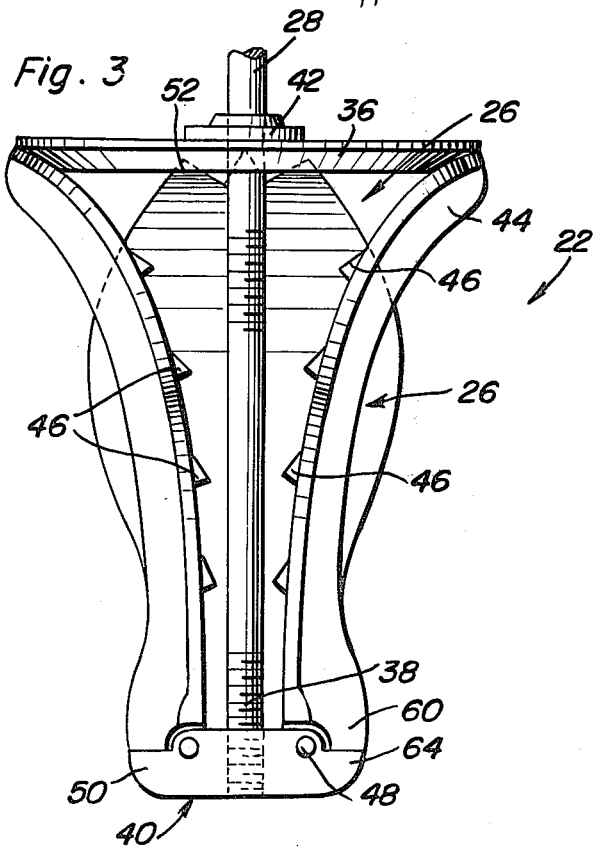
FIG. 3 is an enlarged side elevational view of the expandable portion of a form of the device having four jaws shown in the unexpanded position, as in FIG. 1.
Figure 4:
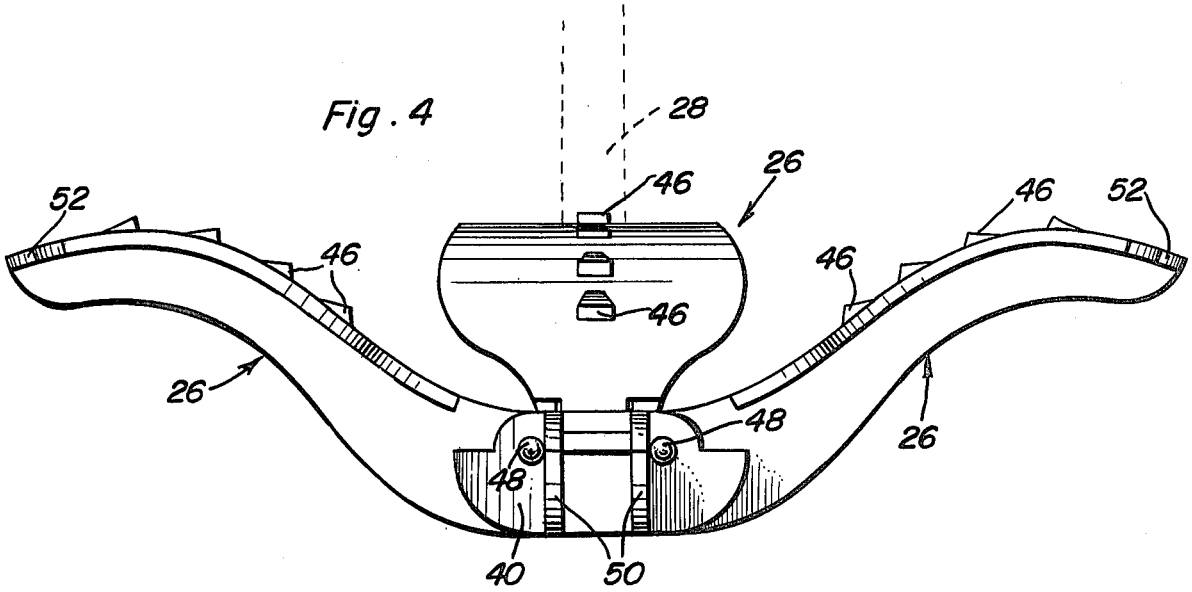
FIG. 4 is a side elevational view of the device of FIG. 3, showing the jaws in fully expanded position, such as shown in FIG. 2.

Further details of the expandable portion 22 of the first form of the invention are shown in FIG. 3 including the back ribs 44 of jaws 26, as well as locking lugs 46 located along the inside or convex surface of jaw 26. Jaws 26 are free to rotate about pivot pin 48, passing through flanges 50 of lock nut 40. Jaws 26 are arched, and further are provided with teeth 52 to insure a secure grip on the underground formation in which expandable portion 22 is placed. FIG. 4 shows the same details as FIG. 3 with pressure plate 36 and anchor rod 28 removed and with blades 26 in the fully expanded position. Anchor rod 28 is shown in phantom in FIG. 4. It is to be understood that one of the four jaws in the expandable portion 22 shown in FIGS. 1, 2, 3 and 4 has been removed to facilitate showing association of component parts, namely that jaw facing the viewer in each drawing.

Figure 5:
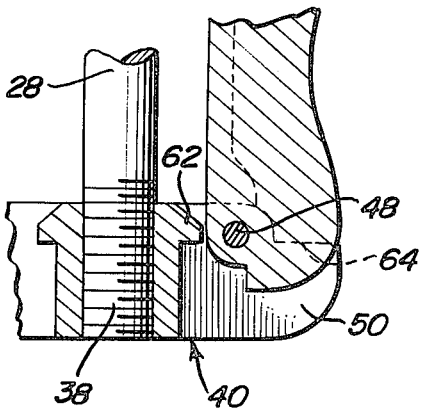
FIG. 5 is an enlarged fragmentary vertical sectional view of the lower part of the expandable portion shown in FIG. 3, showing the structure on which the jaw pivots.

In operation, pressure plate 36 is slipped over lower portion 38 of anchor rod 28 up to welded pressure washer 42. Lower portion 38 of rod 28 is inserted into lock nut 40 and rotated from above ground until its thread is flush with the bottom of lock nut 40, as shown in FIGS. 3 and 5. Jaws 26 are then lifted to the position of FIG. 3 and a wire (not shown) is tied around the outside periphery of the blades to hold them in the closed position of FIG. 3. Such wire is selected with a thickness and tensile strength sufficient to assure holding of the jaws together, but with sufficiently low tensile strength to snap when jaws 26 are expanded in the manner described below. In typically sized working examples of the invention, a 16 gauge steel wire has been successfully used for this purpose.

Next, an angular hole 58 is drilled into the earth to a sufficient depth to allow eye section 30 to project above ground level 32. Anchor assembly 24 is inserted into hole 58 with expandable portion 22 near the bottom thereof. Expandable portion 22 can then be buried partially with introduction of some loose soil into hole 58. A chain or cable (not shown) is then attached to eye section 30 and wrapped around a conventional auger. The auger is rotated in a direction which causes lock nut 40 to travel on threaded portion 38 of anchor rod 28 in the direction toward eye section 30, while bringing pressure to bear between pressure plate 36 about its periphery and jaws 26. As jaws 26 expand outwardly, the retaining wire snaps and the auger is rotated for about 10 revolutions. In order to set the teeth 52 of jaws 26 in surrounding soil, the anchor is pulled up slightly by pulling on anchor rod 28. The pull is then released and rotation of anchor rod 28 through eye section 30 is repeated for about 10 more revolutions. The process of pulling upwardly and rotating anchor rod 28 is repeated until expandable portion 22 reaches the fully expanded position, such as that of FIG. 2, at which point the anchor is set. It can be appreciated that in certain ground formations, the expandable portion 22 will not expand to the fully expanded position shown in FIG. 2, but will open to a lesser extent. While it is preferable to open jaws 26 to their maximum feasible extent, when this is not possible and an intermediate opening position is assumed, one of the sets of lugs 46 further removed from the pivot end 60 of jaw 26 can come into locking engagement with pressure plate 36. In any case, lugs 46 prevent closing of the anchor in a working action of load and force jaws 26 to rest on nose seat 62 and heel seat 64 of lock nut 40. The locking action of lugs 46 on jaws 44 prevents closing of expandable portion 22 in a working action of load.

Figure 6:
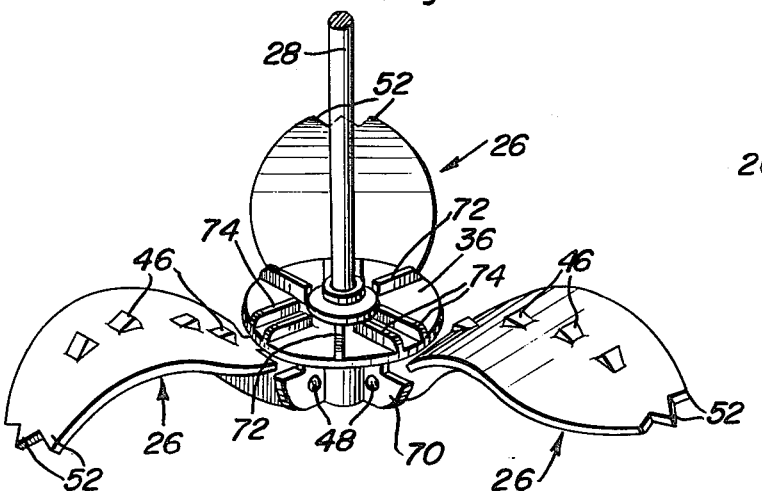
FIG. 6 is a perspective view of the expandable portion of an earth anchor system having three jaws, showing the jaws in fully expanded position.
Figure 9:
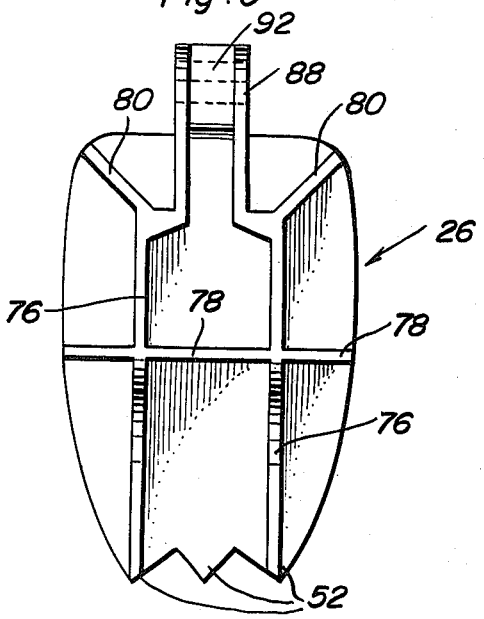
FIG. 9 is a bottom plan view of the same jaw.
Figure 10:
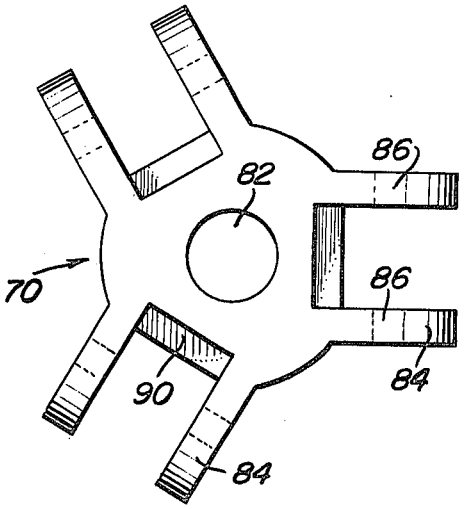
FIG. 10 is a top plan view of the lock nut on which the jaws, such as is illustrated in FIGS. 8 and 9, are mounted to give the device shown in FIG. 6.

While operation of the invention has been described above for the first form of the invention, namely, one having an expandable portion 22 with four expandable jaws, the operation is very similar for the second form of invention, namely, that in which there are only three expandable jaws. Such a construction has fewer moving parts, less weight, and is more easily handled when disassembled, but offers a somewhat less secure grip than the first form, due to fewer jaws in contact with the surrounding earth formation. FIG. 5 illustrates the pivot part of expandable portion 22, and is typical of that joining any jaw 26 to an appropriate lock nut, such as lock nut 40 of a four-jaw assembly or lock nut 70 of the three-jaw assembly. In FIG. 6, pressure plate 36 is shown provided with reinforcement in the form of single ribs 72 and double ribs 74. Moreover, blade 26 is provided with ribbing on its under surface, as best seen in FIG. 9, showing longitudinal ribs 76, transverse ribs 78, and diagonal ribs 80. Lock nut 70, shown in FIG. 10, is adapted for use with three expandable jaws 26, having threaded centrally disposed through hole 82, flange surfaces 84, provided with pivot through holes 86 into which pivot pins 48 pass when through hole 88 of jaw 26 is in register with pivot hole 86. Nose seat 90 provides a ledge upon which a corresponding nose portion 92 of jaw 8 can rest in the expanded position, such as that shown in FIG. 7.

Figure 11:
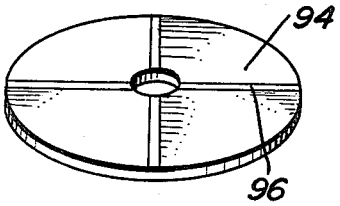
FIG. 11 is a pressure plate used to force jaws outwardly and to protect underlying components from falling soil fragments.
Figure 12:
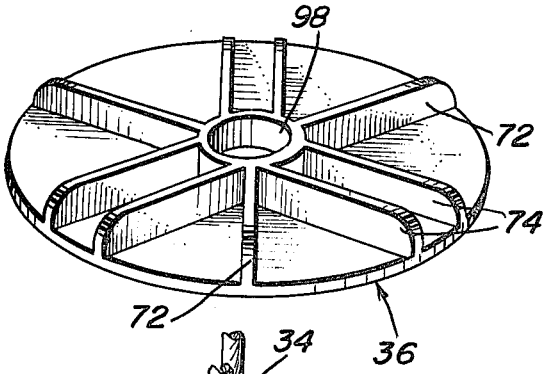
FIG. 12 is an alternate construction of pressure plate exhibiting greater strength and durability due to ribbing reinforcement.
Figure 13:
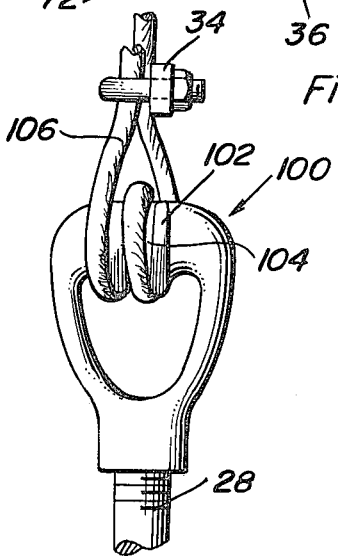
FIG. 13 is a side elevational view of an eye section for fastening of a supporting cable for guide wire showing an associated single cable. Alternatively, two or three cables can be held by the eye section.

FIG. 11 shows a form of pressure plate 94 having a relatively slight degree of ribbing comprising only four radial ribs 96. Pressure plate 36, shown in FIG. 12, has reinforced single ribs 72 and double ribs 74, as well as strengthened collar 98 through which anchor rod 28 passes. Eye section 100 shown in FIG. 13 includes a threaded recess to receive the upper end of threaded anchor rod 28, and ridges 102 form channels 104 within which cable 106 conveniently is seated. Alternatively, channels 104 facilitate connection of more than one cable or guide wire through eye section 100. When so used, a single anchoring system 24 can be used to anchor multiple structures or facilities, thereby saving on expense incident to digging and seating further assemblies unnecessarily.

FIG. 14 discloses a third form of earth anchor assembly 108, which is also preferably placed in a slanting hole 58. Retaining plate 110, having radial ribs 112 for strengthening thereof, is similar in construction to pressure plates 36 or 94 and can, in fact, actually be made from such components. Anchor rod 28 passes through anchor plate 110 and is held thereon by retainer washer 114, which is preferably welded to anchor rod 28 and is provided with radial ribs 116 for strengthening thereof. In order to utilize the third form of the invention, it is inserted into an appropriately angled hole 58, after which soil is placed in hole 58, or, alternatively, for permanent installation, a concrete mixture can be poured into hole 58 and allowed to harden. No auger equipment or other motorized equipment is required to make use of the third form of the invention, but the load supportable by the third form of the invention is not as great as with the expanding jaw arrangement of the first two forms, inasmuch as the third form is held in place only by the weight of soil and associated frictional binding, rather than direct gripping by teeth 52 or expanded jaws 26.

Figure 7:
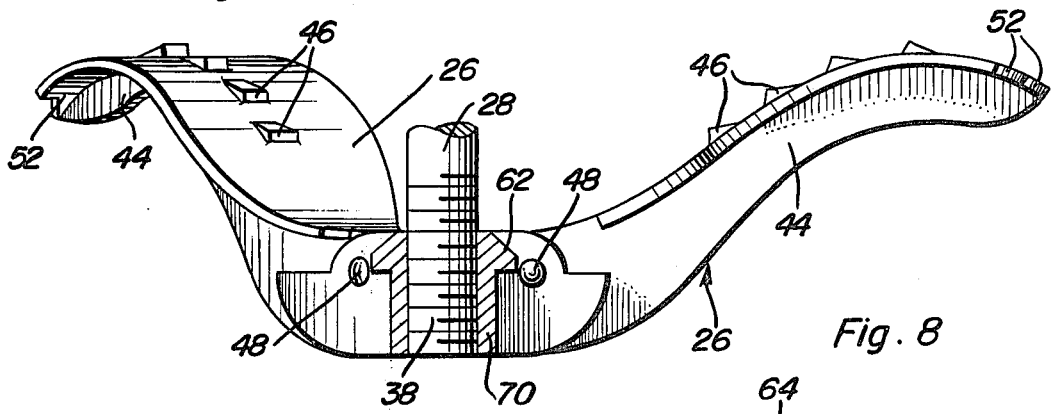
FIG. 7 is a vertical sectional view of the device of FIG. 6 with the pressure plate removed.
Figure 8:
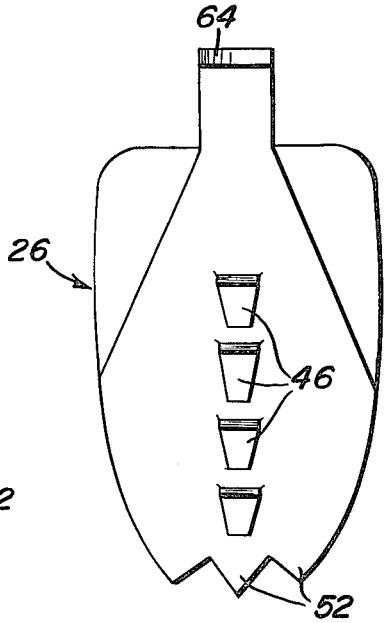
FIG. 8 is a top plan view of a gripping jaw of the earth anchor system of FIG. 6.

While it is not contemplated to limit the invention to any specific size of materials of construction, all equivalent constructions being intended to fall within the scope of the invention, one particular form of invention illustrated in FIGS. 6 and 7 and having a coating 118 on all parts, as illustrated in FIG. 16, was constructed with an overall strength of 35,000 pounds, which is sufficient to exceed U.S. Occupational Safety & Health Administration safety standard requirements. Such a device was constructed from a $\frac{3}{4}$-inch anchor rod 28 formed from ASTM-A 36 hot welded mill steel, having a minimal yield of 36,000 pounds and tensile strength of 50,000 psi. Eye section 100 was hot formed and microwire welded, having dimensions of approximately $2\frac{1}{2}$ inches by 4 inches. Anchor rod 28 had an ultimate strength of 45,000 pounds and a working load when new of 35,000 pounds. Lock nut 70 was formed from type 1028 cast steel having a typical tensile strength of 50,000 psi. Pivot pin 48 was 7/16-inch in diameter, and lock nut 70 had a thickness of $1\frac{1}{2}$ inches. Jaw 26 was formed from type 1040 cast stainless steel having a typical tensile strength of 80,000 psi. Anchor rod 28 was produced in a 12-foot length, and pressure washer 42 was welded in place. When installed according to the method described hereinabove, in a hole 58 oriented at a 60 degree angle from ground level 32, expandable portion 22 was able to withstand as much tension as could be exerted by rod 28, namely, an overall strength of 35,000 pounds. This working load assumes installation at proper depth and formation, in a soil and under moisture conditions with creep, multiple bending and stress factors under controlled conditions.

It is possible to achieve a construction of expandable portion 22 capable of withstanding as much force as can be exerted by anchor rod 28 in part owing to the fact that the load from jaws 26 rests on nose seat 62 and heel seat 64 of lock nut 40, or the corresponding parts of lock nut 70. Accordingly, load on pivot pin 48 is relieved. Top ribbing on pressure plate 36 also reinforces and strengthens expandable portion 22, and pressure plate 36 is cast of type 1028 steel. Moreover, pressure plate 36 locks in place as expandable portion 22 is screwed open, thereby insuring that jaws 26 remain in a position of maximum expansion, constituting a double safety lock.

The arched construction of jaws 26 promotes a fast and easy roll into formations of great density, while the materials of construction permit hardening of jaws 26 to aid in splitting shelf rock or soils which are difficult to cut. Upward jolting of expandable portion 22 during the operation of setting in place forces jaws 26 into the surrounding formation until expandable portion 22 is fully open or open to maximum feasible extent, and jaws 26 are preferably seated on the nose and heel seats of the lock nut for the reasons given above. The locking lugs on the blades thereafter prevent closing of the anchor in a working action of load.

It can be appreciated that anchor rod 28 can also be constructed in a diameter of one inch, giving a heavier but even more secure anchor assembly. When constructed in either the $\frac{3}{4}$ or 1 inch sizes, an end use for utilities and communication structures is particularly contemplated.

An endemic problem with earth anchoring systems results from an accelerated rate of corrosion due to the fact that anchoring assemblies act as an electrical conductor forming an easy path for discharge of electrical potential generated by an anchored structure or from atmospheric electrical charges, or the like. Research indicates that the electrical current is discharged into the surrounding earth in the upper three quarter portion of the buried anchor assembly, the current then traveling downwardly through the surrounding soil and reentering the rod through the cast steel expandable portion, in good electrical contact with the lower portion of rod 28. Evidence of such a mechanism can be found in the observation that heavy corrosion occurs typically on the bottom portion of the rod, along with accompanying deposits of metal oxide at that location. While the theory advanced above is offered to assist in understanding the present invention, proper appreciation of the exact mechanism of corrosion prevention underlying the invention is not necessary for successful implementation and use of the method taught herein. Accordingly, the breadth and scope of the invention contemplated is intended to be limited solely by the scope of the claims and not by any aspect of the theory advanced herein. Prevention of the entrance of electrical current from the soil into expandable portion 22 breaks the electrical circuit and thereby prevents or minimizes electrolytic corrosion of the lower portion of anchor rod 28. To achieve such protection, an epoxy coating over the entire expandable portion of the anchor assembly is applied at a thickness of about 15 mils (381 microns), thereby preventing re-entrance of the electrical current from the soil into the expandable portion 22, while retaining the electrical grounding action of the upper portion of anchor rod 28 and permitting its use as a grounding safety device without the attendant corrosion problems caused by oxidative electrolytic corrosion on the lower portion of rod 28.

A preferred epoxy coating is the fusion-bonded one-part, heat curable, dihydrazide cured, thermosetting powder epoxy coatings applied by a fluid bed or powder spray technique to a preheated expandable portion 22. After assembly of the components of expandable portion 22, all oil, grease, or loosely adhering deposits are removed, followed by abrasive blast cleaning of the surface. Typically, the assembled components are preheated to a temperature of about 400 degrees F. (204 degrees C.) and the epoxy coating powders are applied by a fluid bed or powder spray to a minimum thickness of about 15 mils (381 microns). At the temperature of the article, gelling occurs in about 16 seconds, within which time spraying to the desired thickness should be completed. Curing is then effected by maintaining a temperature of 400 degrees F. (204 degrees C.) for a period of one minute. After curing, the articles is cooled to room temperature, and can be inspected visually and electrically for coating flaws after cooling below 200 degrees F. (96 degrees C.) has occurred. Equipment typically used when spray coating is employed is a powder spray gun, which permits penetration into the various recessed cavities and sharp inside corners of expandable portion 22. A 40 psi, 20 cfm oil-free dry air source is used with a dew point of about minus 20 degrees F. (minus 29 degrees C.). The spray gun is held preferably at a distance of 6 to 12 inches (15 to 30 cm) from the expandable portion to be coated until the entire part has been coated to the desired thickness. When coated in the manner described, positive protection is afforded against oxidation, given an anchor assembly which, if properly installed in the manner described above, should have a useful lifetime of twenty-five years or more without appreciable damage to the anchor assembly.

Although less preferred, a coating technique for expandable portion 22 involving dipping into a supply of polymeric material can also be used, followed by any appropriate curing period necessary for the particular resin selected.

It should again be noted that each of the three forms of the anchor assembly described herein can be, and preferably are, coated for electrolytic corrosion protection necessary for the specific use contemplated as an underground anchor assembly.

It should be noted that anchor rod 28 has been described as preferably having a diameter of $\frac{3}{4}$ inch or 1 inch diameter as is typically required for communications in utility systems. On the other hand, for oil field and high tower systems, a somewhat more substantial construction is required, for which the diameter of the anchor should be $1\frac{1}{8}$ inches to about $1\frac{1}{4}$ inches.

The length of anchor rod 28 to be used is primarily dependent upon the nature of the soil in which it is to be buried. For example, a length of 6 feet is adequate for use with hard rock; an 8-foot rod is sufficient for use in clay; a 10-foot length should be used with loose soft soil; and sand and slush necessitates a 12-foot length.

When constructed and used in accordance with the present invention, the earth anchor assembly 24 described herein exceeds not only U.S. Occupational, Safety and Health Administration requirements, but additionally meets all safety standards for Foundation and Guying or Drilling, Well Servicing Structures for the Oil and Gas Industries, and Oil Well Servicing Rules and Regulations.

Because of the heavy duty structure of anchor system 24, it not only resists an upward pulling force, but also absorbs lateral forces of natures, such as earth tremors, thereby resisting damage and collapse to the above ground structure supported by the anchor system.

With the threaded triple eye shown in FIGS. 14 and 15, parts inventory is standardized, since such an anchoring component can be used for either one, two or three guy wires. Moreover, pulling stresses are more uniformly distributed over individual strands of guy wire than would otherwise result due to spreading, kinking, or bending. Furthermore, if rod 28 is coated as well as expandable portion 22, the coating acts as a smooth protective coating over the rod and if located within the vicinity of people, the rod so coated is not likely to soil or damage personal clothing or belongings. Moreover, if a colored coating is utilized, rod 28 is easily visible by operators of motor vehicles when installed in a location subject to striking such as by vehicles traveling at night or maneuvering while backing up.

The construction of the cast steel anchor of the present invention results in superiority over conventional drop forged or fabricated types in durability, strength and protectability, inasmuch as the cast steel anchor of the present invention is installed in a smaller hole in the ground. Each of the forms of the present invention is safe, compact, durable, lightweight, simple to install, efficient, versatile, reliable, inexpensive, easy to maintain, and conformable to Edison Electric Institute Specifications and State Safety Standards, as well as U.S. Occupational, Safety and Health Administration Standards. While the preferred angle of inclination of the hole in which the anchoring assembly is installed has been described as about 60 degrees, it should be understood that a range of inclinations, such as from about 45 degrees to about 60 degrees, will commonly be used, with the ultimate choice varying according to specific use requirements. In particular, for oil field and high tower anchor applications, a higher angle of inclination, namely an angle of about 45 degrees might be preferable. For some uses, a vertical hole will be the most useful.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method for protecting an earth anchor system from electrolytic oxidative corrosion, said anchor system including a fastening means for anchoring attachment of an above-ground structure and an anchoring means attached to the fastening means for gripping retention below ground level of said fastening means, the method including the steps of:

removing all oil, grease and loosely adhering deposits from said anchor means;

blast cleaning said anchor means with an abrasive material;

heating said anchor means to a temperature of approximately 400° F.;

applying a fusion-bondable one-part heat curable dihydrazide cured, thermosetting powdered epoxy coating to said anchor means;

curing said powdered epoxy at a temperature of approximately 400° F.; and cooling said anchor means to room temperature.

2. The method for protecting an earth anchor system from electrolytic oxidative corrosion as defined in claim 1, wherein said fusion-bondable one-part heat curable dihydrazide cured, thermosetting powdered epoxy coating is applied to a thickness at least 15 mils on said anchor mens.

3. The method for protecting an earth anchor system from electrolytic oxidative corrosion as defined in claim 2, wherein said powdered epoxy coating is applied to said anchor means within 16 seconds so that no gelling occurs before all of said coating is applied.

4. The method for protecting an earth anchor system from electrolytic oxidative corrosion as defined in claim 3, wherein said curing of said powdered epoxy at a temperature of 400° F. is for a period of approximately one minute.

5. The method for protecting an earth anchor system from electrolytic oxidative corrosion as defined in claim 4, wherein said applying of said powdered epoxy coating to said anchor means is accomplished through the use of a powder spray gun.

6. The method for protecting an earth anchor system from electrolytic oxidative corrosion as defined in claim 5, wherein the use of said powder spray gun includes supplying the same with an oil-free supply of dry air at 40 lbs. per square inch and 20 cubic feet per minute.

7. The method for protecting an earth anchor system from electrolytic oxidative corrosion as defined in claim 6, wherein said applying of said powdered epoxy coating by said powder spray gun includes positioning said powder spray gun at a distance of 6 to 12 inches from said anchor means during application of said epoxy coating.

8. The method for protecting an earth anchor system from electrolytic oxidative corrosion as defined in claim 7, wherein said method includes the further step of inspecting for coating flaws on said anchor means when said anchor means has cooled to a temperature of approximately 200° F.

9. The method for protecting an earth anchor system from electrolytic oxidative corrosion as defined in claim 4, wherein said applying of said powdered epoxy coating is accomplished by dipping said anchor means in a fluid bed of said coating.

* * * * *